United States Patent [19]

Weisenberger

[11] 4,429,656

[45] Feb. 7, 1984

[54] TOROIDAL SHAPED CLOSED CHAMBER WHISTLE

[76] Inventor: Richard J. Weisenberger, 8 Kentoboo Dr., Erlanger, Ky. 41018

[21] Appl. No.: 344,364

[22] Filed: Feb. 1, 1982

[51] Int. Cl.[3] ..... B06B 1/18

[52] U.S. Cl. ..... 116/137 R; 116/DIG. 19

[58] Field of Search ..... 116/137 R, 137 A, DIG. 19; 340/406

[56] References Cited

U.S. PATENT DOCUMENTS

| | | | |
|---|---|---|---|
| 48,921 | 7/1865 | Fitts | 116/137 R |
| 596,257 | 12/1897 | Bartlett | 116/137 R |

FOREIGN PATENT DOCUMENTS

| | | | |
|---|---|---|---|
| 84935 | 6/1895 | Fed. Rep. of Germany | 116/137 R |
| 523008 | 4/1931 | Fed. Rep. of Germany | 116/137 |

*Primary Examiner*—Steven L. Stephan
*Assistant Examiner*—Denis E. Corr
*Attorney, Agent, or Firm*—Frost & Jacobs

[57] ABSTRACT

A toroidal shaped closed chamber whistle produces a warning signal capable of being easily heard at relatively great distances from the whistle. The toroidal whistle emits a bidirectional sound which is phase-locked to a particular pitch. The toroidal whistle has a circular plate positioned within a hollow cylinder to form an air passage leading to an annular air slit. Incoming air under pressure flows through the air passage and out of the annular air slit into a toroidal chamber. Within the toroidal chamber, a sound wave is formed which passes out of the toroidal chamber through a chamber mouth. Optionally, two toroidal chambers can be used in combination to produce a dual-tone sound. Additionally, a tremulant device can be used to produce a warbling effect in the emitted sound.

27 Claims, 8 Drawing Figures

TOROIDAL SHAPED CLOSED CHAMBER WHISTLE

BACKGROUND OF THE INVENTION

1. Field of the Invention

This invention relates to the production of sound using a toroidal shaped closed chamber whistle, more particularly the sound output from the toroidal shaped closed chamber whistle can be used as a warning signal of impending natural and man-made disasters such as tornadoes, storms, nuclear power plant failures, among many others. The whistle can either produce the sound of a single tone or a dual tone depending upon the number of toroidal chambers used. A circular plate within a hollow cylinder forms an air passage through which the entering air under pressure flows to an annular air slit. The sound output of the whistle is produced by passing air under relatively low pressure through the annular air slit into a toroidal shaped closed chamber. The sound output is formed within the chamber and is thereby released to the atmosphere through the mouth of the chamber. The sound output is bidirectional with a phase-locked tonal pitch. The sound output is greater for a given pressure than that of a single chamber whistle. Optionally, two toroidal chambers can be used in combination to produce a dual-tone bidirectional sound output with each tone being phase locked.

2. Brief Description of the Prior Art

Warning signals produced by a whistle provide to the listener a valuable cautionary indication of an impending dangerous situation. Warning signals are needed to alert the surrounding community to various imminent dangers such as tornadoes, floodings, accidents, nuclear power plant failures, plus many others. The whistle or warning device used must be capable of producing a very audible sound which can be heard clearly and easily at relatively large distances away from the whistle. The whistle or warning device must also be able to provide an unique and easily distinguishable sound so that the listener can immediately recognize and understand the signal. If the whistle does not have a powerful output and strong sound level, then many individuals who depend upon the warning device will fail to hear the signal. The lives and properties of these individuals could be in danger due to the inadequacies of the warning system.

A formerly used warning system consists of a single chamber device which produced a nondirectional sound output. The single chamber whistle fails to formulate a sound output which is sufficiently audible at relatively large distances of approximately 3 miles. Each single chamber whistle contains only one chamber through which air pressure can pass to form sound waves and, hence, the sound output of the whistle is limited by the capacity of the single chamber. To improve the output from the single chamber whistle, some prior devices combined many different single chamber whistles into one system. Such a system, however, can produce neither a single tone sound nor a directional output. Instead of an easily distinguishable unique sound, the combination of many single chamber whistles produces a multi-pitch sound which merely confuses the listener as to the meaning of the signal. A combination of single chamber whistles cannot be phase-locked to produce a single pitch. The individual whistles of the combination wander out of phase with each other and as a result cancel out each other's output. When the combination of whistles is out of phase, the efficiency and output of the system is reduced.

The present invention obviates these disadvantages by providing a single pitched unique sound output which is readily audible at relatively large distances of approximately 3 miles from the whistle. In contrast to prior warning devices, the toroidal whistle produces a bidirectional sound output. With the present invention, a greater sound output than that of the single chamber whistle can be created while using significantly less air pressure to achieve that output. The present invention allows every point in the toroidal whistle to vibrate in phase with each other and thereby provide a phase-locked sound.

By using an additional toroidal chamber, the present invention can yield a dual-tone bidirectional sound which can be easily heard within a large range of distances of approximately 4 miles from the whistle. The dual-tone toroidal shaped closed chamber whistle permits one whistle to be used as a warning device for a number of various situations by altering the signal emanating from the whistle. The dual-tone toroidal whistle can yield a number of distinct sounds, each of which can serve as a warning signal to a particular danger. The dual-tone whistle eliminates the need of installing a number of single chamber whistles, each of which is used to warn the listener of a particular danger. Optionally, a tremulant device can be used with the toroidal whistle to create an unique warbling effect by altering the air pressure.

SUMMARY OF THE INVENTION

The present invention provides a single-tone toroidal whistle for producing a directional output comprising a hollow cylinder having a closed continuous bottom end and an open top end. The bottom end of the hollow cylinder has a central aperture for the passage of air under pressure into the hollow portion of the hollow cylinder. A circular plate is positioned within the hollow cylinder parallel to the bottom end of the hollow cylinder to form an air passage between the circular plate and the bottom end of the hollow cylinder. The positioning of the circular plate within the hollow cylinder forms an annular air slit between the circular plate and the inner wall of the hollow cylinder. A torus having an interior cavity is positioned on top of the circular plate. A circular cover is affixed to the top of the torus and a lip descends perpendicularly from the circular cover. The lip is tapered to form a point on the lip above the inner wall of the hollow cylinder. The torus, lip, and circular cover together form between them a chamber. Air under pressure from the annular air slit is adapted to pass to form a sound wave within the chamber. The chamber has a width in a predetermined ratio to the length of the chamber.

If a second tone or pitch is desired, then the present invention provides a dual-tone toroidal whistle for producing a directional output comprising a hollow cylinder having a closed bottom end and an open top end. The bottom end of the hollow cylinder has a central aperture for the passage of air under pressure into the hollow portion of the hollow cylinder. A lower circular plate is positioned within the hollow cylinder parallel to the bottom end of the hollow cylinder to form a lower air passage between the lower circular plate and the bottom end of the hollow cylinder. The lower circular plate has a central opening positioned above the central aperture in the bottom end of the hollow cylinder. The positioning of the lower circular plate within the hollow cylinder forms a lower annular air slit between the lower circular plate and the inner wall of the hollow cylinder. A lower torus having a lower interior cavity is positioned on top of the lower circular plate so that the lower interior cavity is above the central opening in the lower circular plate to allow a flow of air under pressure from the lower air passage into the lower interior cavity. A lower circular cover is affixed to the top of the lower torus. The lower circular cover has a hole of a diameter equal to the diameter of the lower interior cavity of the lower torus. A lower lip descends perpendicularly from the lower circular cover with the lower lip being tapered to form a lower point on the lower lip above the inner wall of the hollow cylinder. The lower torus, lower lip, and lower circular cover together form between them a lower chamber. Air under pressure from the lower annular air slit is adapted to pass to form a sound wave within the lower chamber. The lower chamber has a width in a predetermined ratio to the length of the lower chamber. A ring is mounted to the top of the lower torus. The upper circular plate is positioned within the ring parallel to the lower circular cover to form an upper air passage between the upper circular plate and the lower circular cover. The positioning of the upper circular plate within the ring forms an upper annular air slit between the upper circular plate and the inner wall of the ring. An upper torus having an upper interior cavity is positioned on the top of the upper circular plate. An upper circular cover is affixed to the top of the upper torus. The upper lip descends perpendicularly from the upper circular cover with the upper lip being tapered to form an upper point on the upper lip above the inner wall of the ring. The upper torus, upper lip, and upper circular cover together form between them an upper chamber. Air under pressure from the upper annular air slit is adapted to pass to form a sound wave within the upper chamber. The upper chamber has a width in a predetermined ratio to the length of the upper chamber.

It is thus an object of the present invention to provide a closed chamber whistle capable of producing a sound output which is audible at a significant distance from the whistle.

It is an object of the present invention to provide a closed chamber whistle which forms an unique sound easily distinguishable by the listener.

It is an object of the present invention to provide a closed chamber whistle which emits a bidirectional sound output.

It is an object of the present invention to provide a closed chamber whistle which produces a phase-locked tonal pitch.

Further objects and advantages of this invention will become apparent from a study of the following specifications, drawings, and claims.

DESCRIPTION OF THE PREFERRED EMBODIMENT

Figure 2:
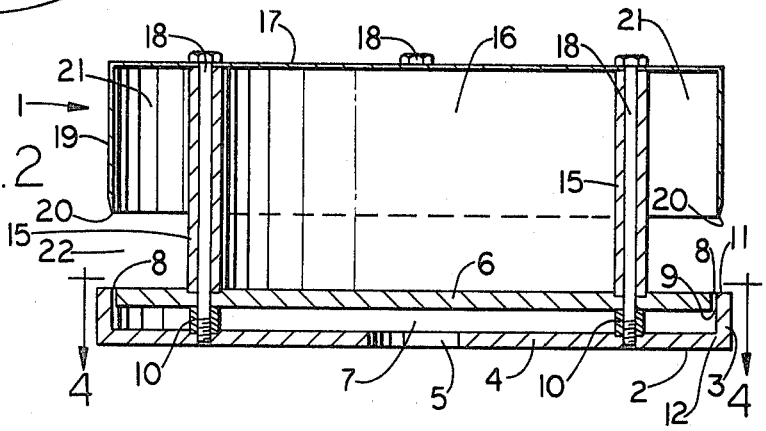
FIG. 2 is a front plan view of a single-tone toroidal shaped closed chamber whistle.
Figure 4:
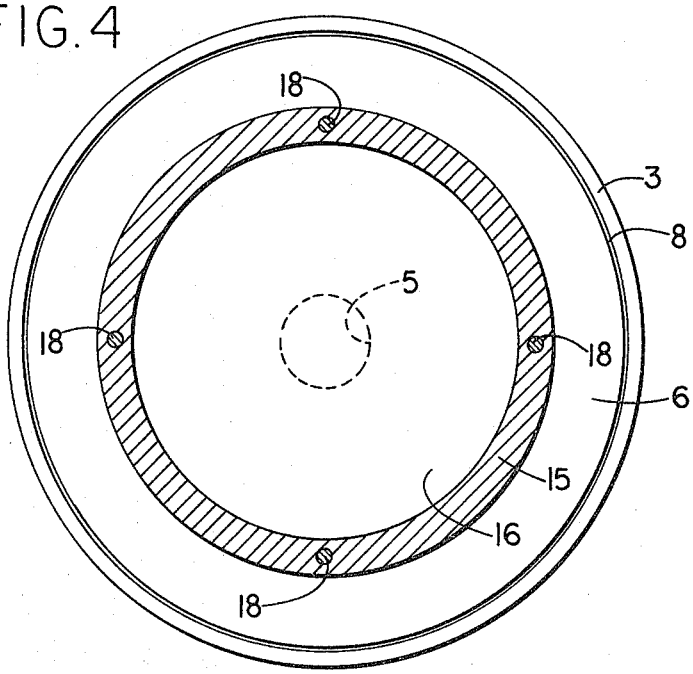
FIG. 4 is a cross-sectional view of a single-tone toroidal shaped closed chamber whistle taken along line 4—4 of FIG. 2.
Figure 5:
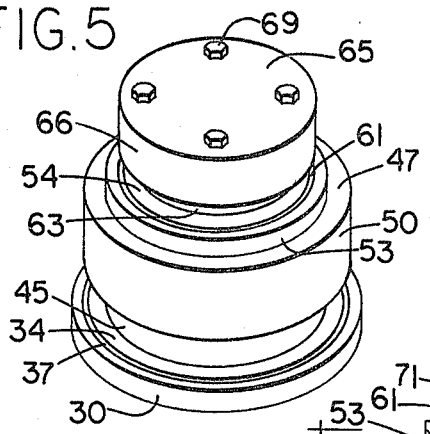
FIG. 5 is a perspective view of a dual-tone toroidal shaped closed chamber whistle.

Referring now to FIG. 2, a front plan view of the single-tone toroidal shaped closed chamber whistle 1 is shown. The toroidal whistle 1 contains an air passage 7, annular air slit 8 and a chamber 21 through which air under pressure flows to create a bidirectional acoustical output.

The bottom exterior portion of the toroidal whistle 1 is constructed from a hollow cylinder 2. Sides 3 and a bottom end 4 continuous with the sides 3 compose the hollow cylinder 2. The hollow cylinder 2 lacks a continuous top end. The sides 3 and the bottom end 4 of the hollow cylinder 2 can be manufactured as one piece to prevent at leakage of air from the hollow cylinder 2. It is essential that no air leaks out of the hollow cylinder 2 at the point 12 where the bottom end 4 joins the sides 3. Preferably, the hollow cylinder 2 as well as all other parts of the toroidal whistle 1 is manufactured from stainless steel, but other steels and metals may also be used.

Figure 3:
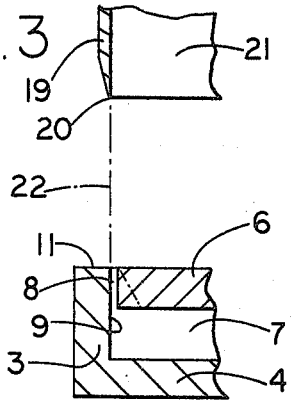
FIG. 3 is a front plan view of the mouth of the single-tone toroidal shaped closed chamber whistle.

The bottom end 4 has a central aperture 5 through which air under pressure can pass into the hollow cylinder 2. The top end of the hollow cylinder 2 is not completely closed off, but rather a circular plate 6 is positioned within the hollow cylinder 2 so that the top of circular plate 6 is level with the upper-most point 11 of the sides 3. The circular plate 6 lies parallel to the bottom end 4 of the hollow cylinder 2. The positioning of the circular plate 6 into the hollow cylinder 2 in this manner forms an air passage 7 between the circular plate 6 and the bottom end 4 into which air under pressure can flow into through the central aperture 5. As shown in FIG. 3, the diameter of the circular plate 6 is less than the inner diameter of the hollow cylinder 2 as measured between the inner wall 9 of the hollow cylinder 2 so that an annular air slit 8 is formed between the circular plate 6 and the inner wall 9 of the hollow cylinder 2.

Optionally, the circular plate 6 can be beveled to increase the width of the annular air slit 8. The beveling is preferably done at a 30° angle with respect to the annular air slit 8 but angles in the range of 25° to 35° are also satisfactory. Spacer means such as an adjustable spacer bar 10 can be used if required to maintain the position of the circular plate 6 above the bottom end 4. The spacer bar 10 is not circular and continuous along the bottom end 4, but rather it is intermittently located on the bottom end 4 to prevent the blockage of the air passage 7. Air pressure must be able to flow out of the air passage 7 to the annular air slit 8 and, hence, the spacer bar 10 cannot be continuous along the bottom end 4 so as to block the air flow.

Positioned on top of the circular plate 6 is a torus 15 which has an outer diameter less than the diameter of the circular plate 6. The torus 15 has an interior cavity 16, the diameter of which is greater than the diameter of the central aperture 5. Affixed to the top of the torus 15 and providing an upper boundary for the interior cavity 16 is a circular cover 17. The diameter of the circular cover 17 is greater than the sum of the diameter of the circular plate 6 plus the annular air slit 8 but less than the outer diameter of the hollow cylinder 2. Such a diameter enables the circular cover 17 to both enclose the upper portion of the chamber 21 and to position properly a point 20 on a lip 19 directly above the inner wall 9 of the hollow cylinder 2. The point 20 should be no thicker than the width of the annular air slit 8.

Fastening means, such as at least one pin 18, secures the circular cover 17 to the torus 15. The torus 15 must be connected to both the circular cover 17 and the circular plate 6 in an air-tight manner to seal off the interior cavity 16. If at least one pin 18 is used to affix the circular cover 17 to the torus 15, then the pin 18 can be extended through both the torus 15 and the circular plate 6 to the bottom end 4. Such a positioning of the pin 18 would permit the circular cover 17 to be mounted air tightly to the torus 15 and the torus 15 in turn to be connected air tightly to the circular plate 6. The pin 18 can also be used to fasten the circular plate 6 to the bottom end 4 of the hollow cylinder 2 by extending the pin 18 through the circular plate 6 to the bottom end 4.

As shown in FIG. 3, the lip 19 descends perpendicularly from the circular cover 17 towards the annular air slit 8. The lip 19 is tapered to form a point 20 at a position directly above the inner wall 9 of the hollow cylinder 2. The torus 15, the circular cover 17, and the lip 19 enclose between them the chamber 21. The chamber 21 is totally enclosed except for the mouth 22 formed between the point 20 and the inner wall 9 of the hollow cylinder 2. For the greatest output efficiency, the height of the mouth 22 is equivalent to the width of the chamber 21.

In the operation of the toroidal whistle, air under pressure enters the air passage 7 through the central aperture 5. The air under pressure can be produced by a blower, an air compressor, or many other devices. The air under pressure flows through the air passage 7 to the annular air slit 8. As the air under pressure is discharged from annular air slit 8, it partially passes into the chamber 21 through the mouth 22. Other portions of the air under pressure from the annular air slit 8 either strike the point 20 on the lip 19 or pass into the surrounding atomosphere. Sound waves are formed within the chamber 21 and are subsequently released to the surrounding atmosphere through the mouth 22. The frequency produced within the toroidal whistle can be altered by varying the dimensions of the chamber especially the ratio of the height of the chamber to its width. Without being bound by theory, it is believed that the frequency of the sound produced by the toroidal whistle is equal to the speed of sound divided by the wavelength of the sound. The wavelength of the sound produced by the toroidal whistle is determined by the dimensions of the chamber according to the formula $\lambda=4(H+0.4W)$ wherein H is the height of the chamber and W is the width of the chamber.

In the preferred embodiment of the toroidal whistle 1, the thickness of the hollow cylinder 2 and the thickness of the circular plate 6 each is preferably one-half that of the width of the torus 15. Optimally, the thickness of the hollow cylinder 2 and the circular plate 6 is 0.50 inches each while the torus 15 is 1 inch wide, but other dimensions are allowed so long as the material is structurally sound to prevent bending during operation. Preferably, the diameter of the central aperture 5 is 3 inches, but other diameters are permitted so long as the area of the central aperture 5 is greater than the area of the annular air slit 8. Diameters in the range of 3 to 6 inches are acceptable. The circular plate 6 preferably is at a height of at least 0.75 inches above the bottom end 4, but heights in the range of 1 inch to 1.5 inches are permitted. Preferably, the annular air slit 8 has a width of 0.0625 inches, but widths of 0.0575 inches to 0.0675 inches are workable.

Figure 8:
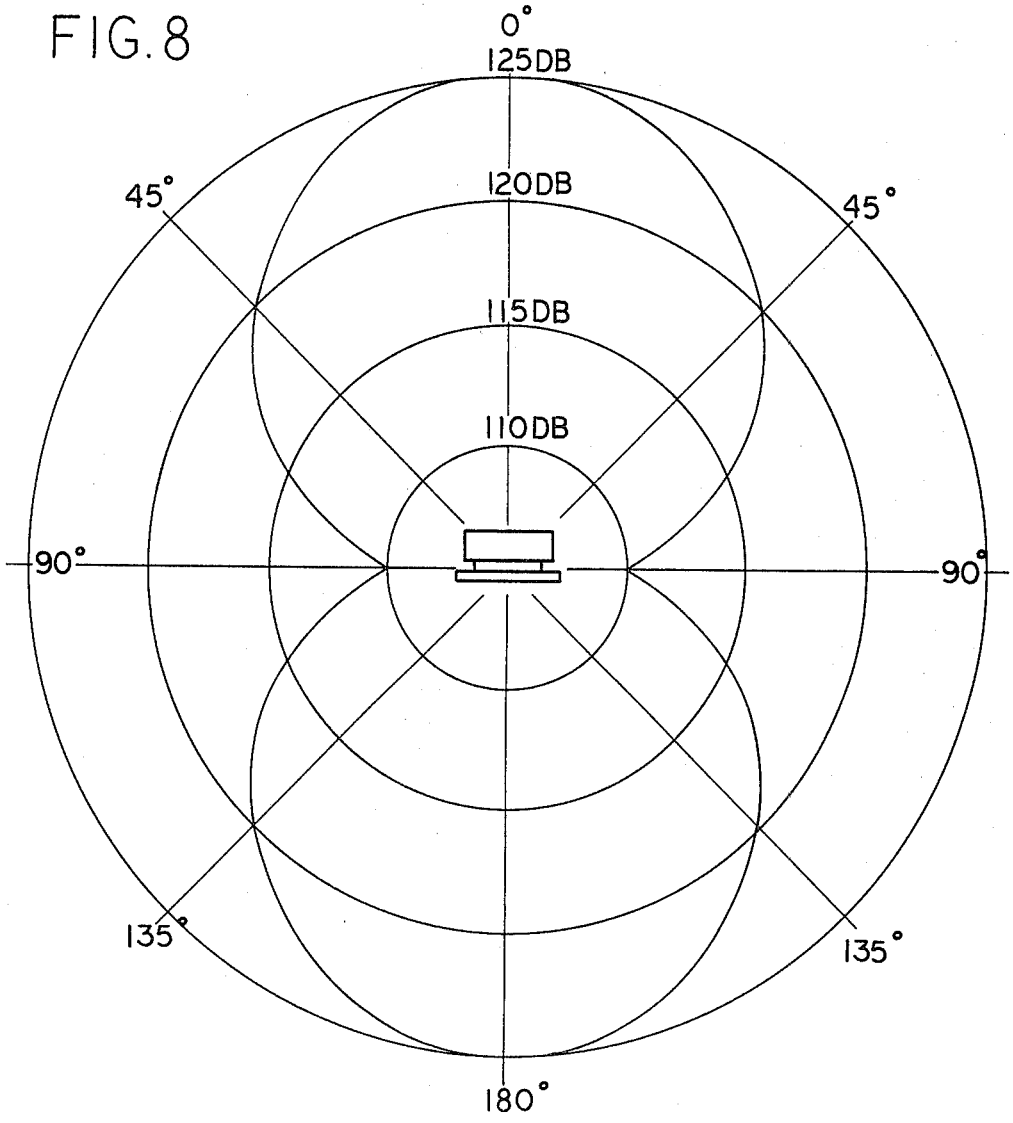
FIG. 8 is a calculated polar pattern for a single-tone toroidal shaped closed chamber whistle at a distance of 100 feet from the whistle compared to the polar pattern for the single chamber whistle.

In the preferred embodiment of the toroidal whistle 1, the height of the point 20 above the inner wall 9 is preferably equivalent to the width of the chamber 21. The lip 19 of the circular cover 17 tapers at a 15° angle, although taper angles of 13° to 17° are acceptable. Preferably, the height of the chamber 21 is three times that of the width of the chamber 21, for the greatest output from the toroidal whistle. For optimum results, the outer diameter of the toroidal chamber is $0.625\lambda$ since at the diameter, as shown in FIG. 8, the sound output 90° off axis is equal to that of a single chamber conventional whistle (110 decibels) while the output on axis is 15 decibels greater than a conventional whistle, which is equivalent to 25 times greater output. Since the height to width ratio of 3:1 for chamber 21 and the value of $0.625\lambda$ for the outside diameter of the toroid are critical for optimum performance, the actual dimensions are inversely proportional to the frequency for which the device is designed. Thus, larger dimensions would be provided for lower frequency, and smaller dimensions would be provided for higher frequency, for optimum results. A a frequency of 440 hertz, a toroidal chamber outside diameter of 20 inches and an inside diameter of about 15.2 inches would achieve maximum output.

If air at a pressure of 10 p.s.i. is introduced into the preferred embodiment of the toroidal whistle 1, a sound wave with a frequency of approximately 440 hertz and a sound level of 125 decibels at 100 feet is produced. As shown in FIG. 8, the tone of the toroidal whistle is single tone and bidirectional. If the toroidal whistle is rotated on its axis, then the sound level of 125 decibels will be dispersed over the entire surrounding 360° area. Without being bound by theory, the whistle of the present invention produces a bidirectional output since the width of the toroidal chamber is a significant percentage of the wavelength but the cross-sectional area of the toroidal chamber is small compared to the wavelength of the sound output. A frequency of approximately 440 hertz is preferred since sound of such a frequency carries well over a long distance due to minimal environmental absorption.

In contrast, the conventional single chamber whistle requires air at a pressure of 40 p.s.i. to produce a sound level of 110 decibels at 100 feet. Hence, the present invention requires one-fourth the air pressure to produce 25 times the sound output of the single chamber whistle. The present invention uses an annular air slit 8 of maximum efficiency to minimize the operating pressure needed to produce a given sound output.

Figure 1:
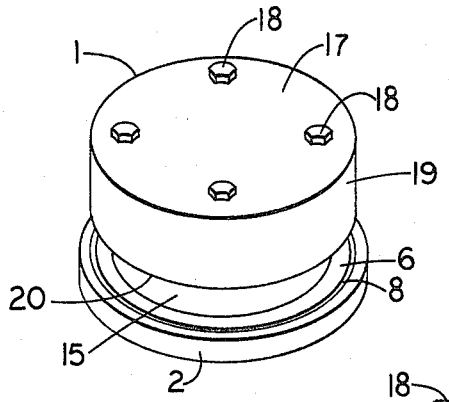
FIG. 1 illustrates a perspective view of a single-tone toroidal shaped closed chamber whistle.
Figure 6:
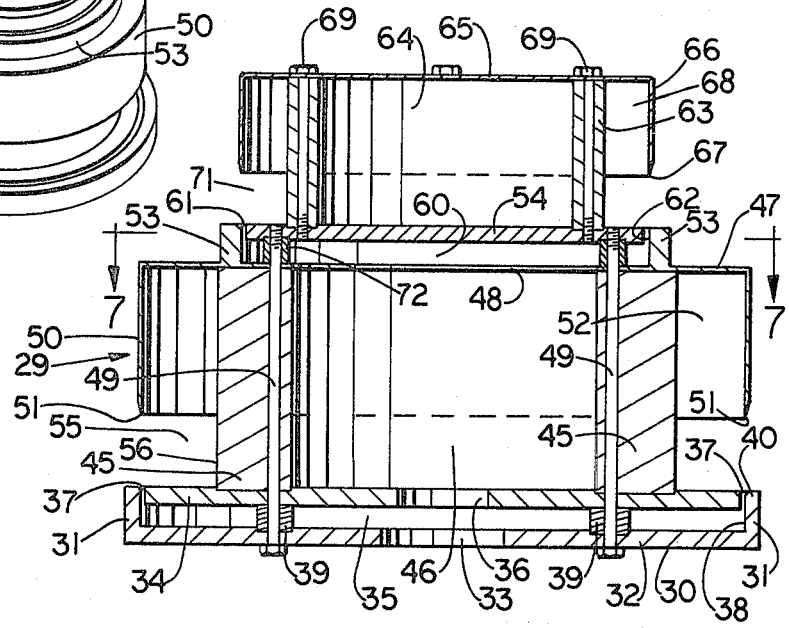
FIG. 6 is a front plan view of a dual-tone toroidal shaped closed chamber whistle.
Figure 7:
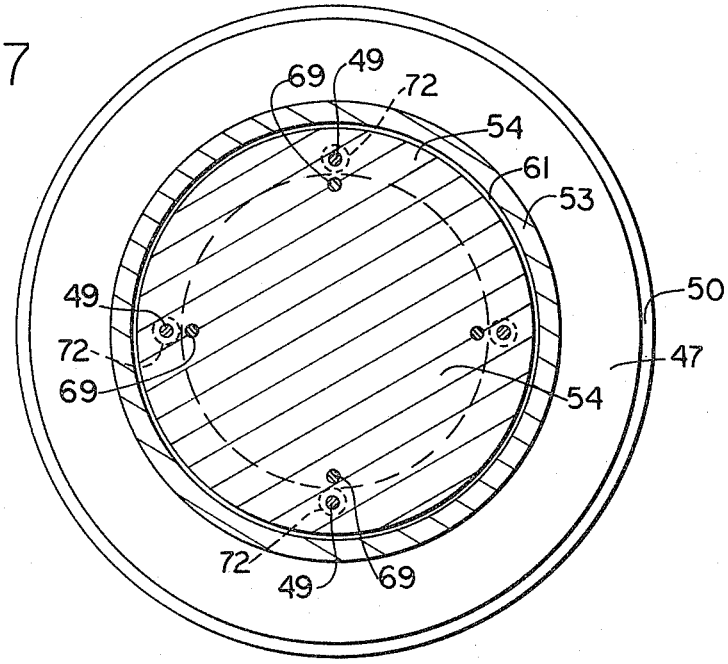
FIG. 7 is a cross-sectional view of a dual-tone torodial shaped closed chamber whistle taken along line 7—7 of FIG. 6.

Referring now to FIG. 6, a front plan view of a dual-tone toroidal shaped closed chamber whistle 29 is shown. The dual-tone toroidal whistle 29 is a modification of the single-tone toroidal whistle 1 shown in FIG. 1. The second tone is formed by mounting an upper torus 63 to the lower torus 45 and by channeling part of the incoming air under pressure into the upper toroidal chamber 68.

As in the single-tone toroidal whistle 1, a hollow cylinder 30 having sides 31 and a continuous bottom end 32 are joined together so as to be air tight. The hollow cylinder 30 lacks a continuous top end. The bottom end 32 of the hollow cylinder 30 has a central aperture 33 through which air under pressure can enter into the lower air passage 35. A lower spacer means such as an adjustable spacer bar 39 is positioned intermittently on the bottom end 32 to hold the lower circular plate 34 parallel to the bottom end of 32. The spacer bar 39 must not totally block the flow of air under pressure through the air passage 35.

A lower circular plate 34 is positioned within the hollow cylinder 30 in such a manner that the top of the lower circular plate 34 is level with the uppermost point 40 of the hollow cylinder 30. The lower circular plate 34 lies parallel to the bottom end 32 and has a central opening 36. The central opening 36 lies above the central aperture 33.

A lower annular air slit 37 is formed between the lower circular plate 34 and the inner wall 38 of the hollow cylinder 30. To increase the size of the lower annular air slit 37, the lower circular plate can be beveled. A bevel angle 30° relative to the lower annular air slit 37 is recommended, but angles in the range of 25° to 35° are also satisfactory.

The lower torus 45 is mounted to the top of the lower circular plate 34. Affixed to the top of the lower torus 45 is a lower circular cover 47 with a perpendicularly descending lower lip 50. The lower torus 45 has a diameter less than that of the lower circular plate 34. Within the lower torus 45 is a lower interior cavity 46 with a diameter greater than that of the central opening 36. The lower circular cover 47 has a hole 48 corresponding in diameter to that of the lower interior cavity 46.

The lower lip 50 tapers to a lower point 51 positioned above the inner wall 38 of the hollow cylinder 30. A lower chamber 52 is enclosed by the lower torus 45, the lower circular plate 47, and the lower lip 50. A lower mouth 55 is defined between the lower point 51 and the inner wall 38 of the hollow cylinder 30. Fastening means such as at least one pin 53 is used in the same manner as in the single-tone toroidal whistle 1 to fasten together in an air-tight manner the lower circular cover 47, the lower torus 45, and the lower circular plate 34. The diameter of the lower circular cover 47 is greater than the sum of diameter of the lower circular plate 34 plus the lower annular air slit 37 but less than the outer diameter of the hollow cylinder 30 in order that the position of the lower point 51 may be above the inner wall 38.

A ring 53 is mounted to the top of the lower circular plate 47 near the point on the lower circular plate 47 where the outer wall 56 of the lower torus 45 joins the lower circular plate 47. An upper circular plate 54 is positioned within the ring 53 in the same manner that the lower circular plate 34 is placed within the hollow cylinder 30. An upper passage 60 is formed between the upper circular plate 54 and the lower circular cover 47 with hole 48 while an upper annular air slit 61 is enclosed by the upper circular plate 54 and the ring 53. Optionally, the upper circular plate 54 can be beveled, preferably, at a 30° angle with respect to the upper annular air slit 61 to increase with width of the upper annular air slit 61, but angles in the range of 25° to 35° are also satisfactory.

An upper torus 63 is positioned on the top of the upper circular plate 54 with the upper torus 63 having an outer diameter less than the diameter of the upper circular plate 54 but a diameter greater than the diameter of the lower cavity 46. An upper interior cavity 64 is bound by the upper torus 63, the upper circular plate 54, and the upper circular cover 65. The diameter of the upper interior cavity 64 is less than the diameter of the lower interior cavity 46.

An upper circular cover 65 is affixed to the top of the upper torus 63 with an upper lip 66 descending perpendicularly from the upper circular cover 65. The upper lip 66 tapers to an upper point 67 directly above the inner wall 70 of the ring 53. An upper chamber 68 is enclosed by the upper lip 66, the upper circular cover 65, and the upper torus 63. The upper mouth 71 is defined between the upper point 67 and the inner wall 70 of the ring 53. An upper spacer means such as an adjustable spacer bar 72 similar to the lower spacer bar 39 is positioned intermittently on top of the lower circular cover 47. A connecting means such as at least one pin 69 attaches the upper circular cover 65 to the upper torus 63 much like the way the fastening means 49 attaches the lower circular cover 47 to the lower torus 45. The thickness of the lower point 51 and the upper point 67 should not be greater than the width of the lower annular air slit 37 and the upper annular air slit 61, respectively.

All of the various parts of the dual-tone toroidal whistle 29 can be manufactured from stainless steel, metal, or any other strong, noncorroding metals. The whistle must be manufactured so that the respective circular covers, torus, and circular plate are sealed in an air-tight manner.

Optionally, a tremulant device (not shown) can be attached to either the single-tone toroidal whistle 1 or to the dual-tone toroidal whistle 29 to produce a warbling effect in the sound waves emanating from the toroidal chamber. The tremulant device is installed near either the central aperture 5 of the single-tone toroidal whistle or the central aperture 33 of the dual-tone toroidal whistle. The tremulant device varies the air under pressure entering the toroidal whistle. The tremulant device allows the user of the whistle to vary the produced sound so that the resulting sound is unique.

In the operation of the dual-tone toroidal whistle 29, air under pressure enters the air passage 35 through the central aperture 33. Part of the air under pressure flows into the lower interior cavity 46 through the central opening 36. The remainder of the air under pressure passes through the lower annular air slit 37 and then either strikes the lower lip 50 or passes into the lower chamber 52. Sound waves are formed within the lower chamber 52 and they are released through the lower mouth 55. The air under pressure which has entered the lower interior cavity 46 flows into the upper air passage 60 through the hole 48. The air under pressure is channeled through the upper air passage 60 into the upper annular air slit 61 and then it either strikes the upper lip 66 or passes into the upper chamber 68. Sound waves are formed within the upper chamber 68 and are released through the upper mouth 71. Due to the construction of the toroidal whistle 29, the tones produced in each chamber will be distinct. As in the single-tone toroidal whistle, the frequency of the sound wave produced within each chamber of the dual-tone toroidal whistle can be altered by varying the dimensions of the chamber, especially the ratio of the height of the chamber to its width.

In the preferred embodiment of the dual-tone toroidal shaped closed chamber whistle 29, the thickness of the hollow cylinder 30 and the lower circular plate 34 are the same while the width of the lower torus 45 is twice that of this thickness. Optimally, the hollow cylinder 30 and the lower circular plate 34 are each 0.50 inches thick while the lower torus 45 is 1 inch thick. Other dimensions are allowed so long as the material is structurally sound to prevent bending during operation. Preferably, the central aperture 33 has a diameter of 4 inches, but a diameter in the range of 4 inches to 6 inches is acceptable. The area of the central aperture 33 should be greater than the area of the lower annular air slit 37. The lower circular plate 34 is preferably at least 1 inch above the bottom end 32, but heights as great as 1.5 inches are permitted. The central opening 36 in the lower circular plate 34 should be at least 3 inches in diameter, but diameters as great as 4 inches are acceptable.

Optimally, the lower annular air slot 37 has a width of 0.0625 inches, but widths between 0.0575 inches and 0.0675 inches are permitted. The height of the lower point 51 above the inner wall 38 is equivalent to the width of the lower chamber 52. The lower lip 50 and the upper lip 66 taper at a 15° angle, but angles of 13° to 17° are acceptable. The length of the lower chamber 52 is optimally three times that of the width of the lower chamber 52.

In the preferred embodiment of the dual-tone whistle 29, the diameter of the lower circular plate 34 is one and one-half times that of the upper circular plate 54. Similarly, the width of the lower chamber 45 should be one and one-half times that of the upper chamber 68. The length of the upper chamber 68 is optimally three times that of the width of the upper chamber 68. Optimally, for maximum output, the diameter of the upper torus is approximately 10.1 inches and the diameter of the lower torus is 15.2 inches. Toroidal diameters significantly less than these measurements decrease the overall output of the whistle while significantly larger toroidal diameters decrease the output off axis.

If air at a pressure of 10 p.s.i. is introduced into a preferred embodiment of the dual-tone toroidal whistle, then a bidirectional sound wave with a sound level of 128 decibels at 100 feet is produced. The whistle 29 produces a dual-tone output in which the lower chamber 52 emits a sound wave with a frequency of approximately 440 hertz and the upper chamber 68 produces a sound wave of approximately 660 hertz. In comparison, the single chamber whistle formulates a sound level of 110 decibels at 100 feet even when air at a pressure of 40 p.s.i. is introduced into the single chamber whistle. Other sound levels and frequencies are achievable in the dual-tone toroidal whistle by changing the various dimensions of the whistle.

What is claimed is:

1. A single-tone toroidal whistle for producing a directional output comprising:

(a) a hollow cylinder having a closed continuous bottom end and having an open top end;

(b) the bottom end of said cylinder having a central aperture for the passage of air under pressure into the hollow portion of said hollow cylinder;

(c) a circular plate positioned within said hollow cylinder parallel to the bottom end of said hollow cylinder to form an air passage between said circular plate and the bottom end of said hollow cylinder, said circular plate positioned within said hollow cylinder to form an annular air slit between said circular plate and the inner wall of said hollow cylinder;

(d) a torus positioned on top of said circular plate, said torus having an interior cavity;

(e) a circular cover affixed to the top of said torus;

(f) a lip descending perpendicularly from said circular cover, said lip being tapered to form a point on said lip above said inner wall of said hollow cylinder;

(g) said torus, said lip, and said circular cover together forming between them a chamber, air under pressure from said annular air slit being adapted to pass to form a sound wave within said chamber, said chamber having a width in a 1 to 3 ratio to the length of said chamber, the outer diameter of said chamber being about 0.625 times the fundamental wavelength of said sound wave.

2. A single-tone toroidal whistle as described in claim 1, further comprising a fastening means for joining together air tightly said circular cover, said torus, and said circular plate and for further securing said circular plate to the bottom end of said hollow cylinder.

3. A single-tone toroidal whistle as described in claim 2, wherein said fastening means is at least one pin.

4. A single-tone toroidal whistle as described in claim 1, further comprising a spacer means for positioning said circular plate above the bottom end of said hollow cylinder.

5. A single-tone toroidal whistle as described in claim 4, wherein said spacer means is an adjustable spacer bar to vary the height at which said circular plate is maintained above the bottom end of said hollow cylinder.

6. A single-tone toroidal whistle as described in claim 1, wherein said circular plate is beveled along the edge thereof to increase the width of said annular air slit.

7. A single-tone toroidal whistle as described in claim 1, wherein said torus has a diameter less than the diameter of said circular plate.

8. A single-tone toroidal whistle as described in claim 1, wherein said interior cavity of said torus has a diameter greater than the diameter of said aperture in the bottom end of said hollow cylinder.

9. A single-tone toroidal whistle as described in claim 1, wherein said circular cover has a sufficient diameter to position said point on said lip directly above said inner wall of said hollow cylinder.

10. A single-tone toroidal whistle as described in claim 1, wherein the width of said chamber is the same as the height of said point of said lip above said inner wall of said hollow cylinder.

11. A dual-tone toroidal whistle for producing a directional output comprising:

(a) a hollow cylinder having a closed bottom end and having an open top end;

(b) the bottom end of said hollow cylinder having a central aperture for the passage of air under pressure into the hollow portion of said hollow cylinder;

(c) a lower circular plate positioned within said hollow cylinder parallel to the bottom end of said hollow cylinder to form a lower air passage between said lower circular plate and the bottom of said hollow cylinder, said lower circular plate having a central opening positioned above said central aperture in the bottom end of said hollow cylinder, said lower circular plate positioned within said hollow cylinder to form a lower annular air slit between said lower circular plate and the inner wall of said hollow cylinder;

(d) a lower torus having a lower interior cavity positioned on top of said lower circular plate so that said lower interior cavity is above said central opening in said lower circular plate to allow a flow of air under pressure from said lower air passage into said lower interior cavity;

(e) a lower circular cover affixed to the top of said lower torus, said lower circular cover having a hole of diameter equal to the diameter of said lower interior cavity of said lower torus;

(f) a lower lip descending perpendicularly from said lower circular cover, said lower lip being tapered to form a lower point on said lower lip above said inner wall of said hollow cylinder;

(g) said lower torus, said lower lip, and said lower circular cover together forming between them a lower chamber, air under pressure from said lower annular air slit being adapted to pass to form a first sound wave within said lower chamber, said lower chamber having a width in a 1 to 3 ratio to the length of said lower chamber, the outer diameter of said chamber being about 0.625 times the fundamental wavelength of said first sound wave.

(h) a ring mounted to the top of said lower torus;

(i) an upper circular plate positioned within said ring parallel to said lower circular cover to form an upper air passage between said upper circular plate and said lower circular cover, said upper circular plate positioned within said ring to form an upper annular air slit between said upper circular plate and said inner wall of said ring;

(j) an upper torus having an upper interior cavity, said upper torus positioned on top of said upper circular plate;

(k) an upper circular cover affixed to the top of said upper torus;

(l) an upper lip descending perpendicularly from said upper circular cover, said upper lip being tapered to form an upper point on the upper lip above said inner wall of said ring;

(m) said upper torus, said upper lip, and said upper circular cover together forming between them an upper chamber, air under pressure from said upper annular air slit being adapted to pass to form a second sound wave within said upper chamber, said upper chamber having a width in a 1 to 3 ratio to the length of said upper chamber, the outer diameter of said chamber being about 0.625 times the fundamental wavelength of said second sound wave.

12. A dual-tone toroidal whistle as described in claim 11, further comprising a fastening means for joining together air tightly said lower circular cover, said lower torus, and said lower circular plate and for further securing said lower circular plate to the bottom end of said hollow cylinder.

13. A dual-tone toroidal whistle as described in claim 12, wherein said fastening means is at least one pin.

14. A dual-tone toroidal whistle as described in claim 11, further comprising a connecting means for joining together air tightly said upper circular cover, said upper torus, and said upper circular plate.

15. A dual-tone toroidal whistle as described in claim 14, wherein said connecting means is at least one pin.

16. A dual-tone toroidal whistle as described in claim 11, further comprising a spacer means for positioning said lower circular plate above the bottom end of said hollow cylinder.

17. A dual-tone toroidal whistle as described in claim 16, wherein said spacer means is an adjustable spacer bar to vary the height at which said circular plate is maintained above the bottom end of said hollow cylinder.

18. A dual-tone toroidal whistle as described in claim 11, wherein both said upper circular plate and said lower circular plate are beveled along the edge to increase the width of said upper and lower annular air slits.

19. A dual-tone toroidal whistle as described in claim 11, wherein said lower torus has a diameter less than the diameter of said lower circular plate.

20. A dual-tone toroidal whistle as described in claim 11, wherein said lower interior cavity has a diameter greater than the diameter of said central aperture in the bottom end of said hollow cylinder.

21. A dual-tone toroidal whistle as described in claim 11, wherein said lower circular cover has a sufficient diameter to position said lower point on said lower lip directly above said inner wall of said hollow cylinder.

22. A dual-tone toroidal whistle as described in claim 11, wherein said ring has a diameter less than the diameter of said lower torus but greater than the diameter of said lower interior cavity.

23. A dual-tone toroidal whistle as described in claim 11, wherein said upper torus has a diameter less than the diameter of said upper circular plate.

24. A dual-tone toroidal whistle as described in claim 11, wherein said upper interior cavity has a diameter less than the diameter of said lower interior cavity.

25. A dual-tone toroidal whistle as described in claim 11, wherein said upper circular cover has a sufficient diameter to position said upper point on said upper lip directly above said inner wall of said ring.

26. A dual-tone toroidal whistle as described in claim 11, wherein the width of said upper chamber is the same as the height of said upper mouth.

27. A dual-tone toroidal whistle as described in claim 11, wherein the width of said lower chamber is the same as the height of said lower mouth.

* * * * *